United States Patent [19]

Altpeter et al.

[11] Patent Number: 5,060,915

[45] Date of Patent: Oct. 29, 1991

[54] TWO-PIECE TERMINAL BRICK

[75] Inventors: Sabine Altpeter, Villach; Helmut Vacek, Weissenstein; Bernd Grabner, Millstatt, all of Fed. Rep. of Germany

[73] Assignee: Radex-Heraklith Industriebeteiligungs Aktiengesellschaft, Austria

[21] Appl. No.: 403,666

[22] Filed: Sep. 6, 1989

[30] Foreign Application Priority Data

Sep. 7, 1988 [DE] Fed. Rep. of Germany ..... 3830342

[51] Int. Cl.[5] ..... C21C 5/42

[52] U.S. Cl. ..... 266/236; 266/286; 222/591; 222/594

[58] Field of Search ..... 266/236, 280, 286; 222/591, 594, 601, 597

[56] References Cited

U.S. PATENT DOCUMENTS

| | | | |
|---|---|---|---|
| 4,327,847 | 5/1982 | Tinnes | 222/591 |
| 4,427,184 | 1/1984 | Steinwider et al. | 266/236 |
| 4,756,452 | 7/1988 | Tsukamoto et al. | 266/236 |

FOREIGN PATENT DOCUMENTS 2918333 7/1988 Fed. Rep. of Germany .

OTHER PUBLICATIONS

*Iron and Steel Engineer*, p. 31, 7–84.

*Primary Examiner*—S. Kastler

*Attorney, Agent, or Firm*—John F. A. Earley; John F. A. Earley, III

[57] ABSTRACT

The invention concerns a fireproof ceramic terminal brick for a tapping system in particular in steel converters or electric furnaces composed of several fireproof ceramic founder's bricks arranged in a row, together enclosing a passage opening for the steel smelt, thereby characterized in that the terminal brick is formed in two pieces vertical to the direction of flow of the steel smelt and the lower section in the direction of flow of the smelt is formed as a cylindrical body that can be pressed firmly against the upper section of the terminal brick, arranged above it, in such a way as to seal but remaining detachable from it.

17 Claims, 3 Drawing Sheets

TWO-PIECE TERMINAL BRICK

Figure 1:
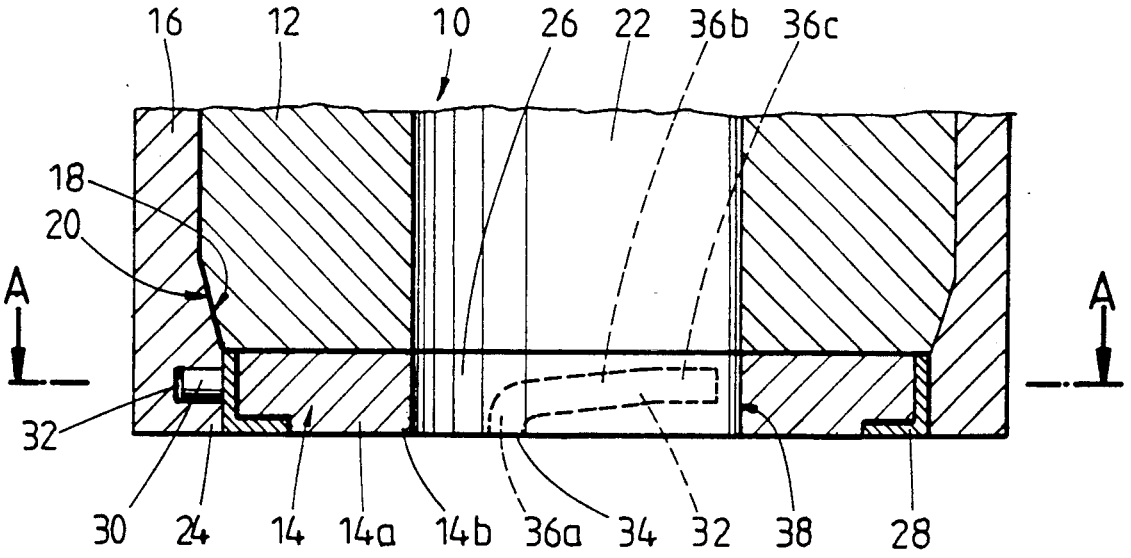

The invention refers to a fireproof ceramic terminal brick for a tapping system, in particular in steel converters or electric furnaces, composed of several fireproof ceramic formed bricks arranged in a row, together enclosing a passage opening for the steel smelt.

Tapping systems of this type are known for converters, for example LD converters bottom tap electric furnaces, but also in non-iron metal assemblies, for example from AT-patent 326 164 or EP-A-171 658.

The individual formed bricks are often cylindrical, but can also be of various shapes and are often connected to one another by tongue and groove connections for purposes of assembly simplification and the formation of a cylindrical passage canal for the metal smelt.

As is shown in the EP-A 171 658, a shut-off plate is often provided at the outlet valve end of the tapping system and prior to introducing the smelt material, a loose, dry, fireproof granulated material is filled into the passage canal and prevented from flowing off by the metal plate at the bottom. But the plate not only prevents the granulated material from flowing off through the bottom, but also serves to take up the static pressure of the metal smelt later. To open and close the tap opening, the plate is simply slid or turned to the side. As soon as the granulated material has then run out, the metal smelt follows the path through the tap into a pan, for example.

In practice it has been shown that quite often erosion is caused by the metal smelt running out, particularly at the outlet end of the tap or, expressed differently, at the outlet (lower) end of the terminal bricks of the tapping system. Due to this, directing the casting stream with accuracy is no longer possible; the casting stream "flutters".

Finally, increasing erosions are accompanied by the danger that the granulated material and/or the metal smelt already escape before opening of the outlet.

This danger is increased even more by the fact that operating personnel "cleans" the outlet valve end of the tap between the individual taps and in so doing, above all, cleans off any adhering slag particles or deposits that have formed there in order to guarantee a sure seal of the bottom plate for the next run-off. However, also in this process additional brick material is torn off and this area is thereby further widened.

The result of all this is that sometimes the desired 100 or 150 charges cannot be casted, but rather the tap has to be improved or renewed before completion.

In the process, either the terminal brick itself or all the bricks of the tap must then be broken removed and replaced, although basically only the outlet valve end section is in need of repair.

The goal of the invention is thus to show how the durability of tapping systems of the type mentioned can be increased. In so doing, it is in particular a question of preserving the essentially still usable parts of the tap for further charges and/or to provide a possibility of repairing the tap or to simplify repairing.

It was found that the aforementioned goal can be achieved if the terminal brick of the tapping system is constructed in two parts, vertically in the direction of flow of the metal smelt, and the lower section, in the direction of flow of the smelt, is formed as a cylindrical body and arranged in such a way that it can be secured to the upper section of the terminal brick, arranged above it, in a sealing manner while also being detachable from it.

An essential characteristic of the invention is then, first the separating of the terminal brick into two sections. This division is carried out in such a way that the lower section covers the area that is particularly endangered by the erosions mentioned. As a rule, this is only a small section at the end.

For this reason, according to an advantageous model of the invention, the cylindrical body should have a lesser height in relation to the upper section and should be disk-shaped with a flow opening.

The other essential feature of the invention is that this lower section is detachable (replaceable) and in such a way that it can be removed from the bottom (viewed in the direction of flow of the smelt), without the upper section of the terminal brick and the other bricks arranged above it having to be removed or otherwise dismantled. Following the state of the art this detachability was not possible because the steel frame is formed conically tapering downwards. In this way, most of the tap can be immediately used for further charges and only the last lower end section is repaired or replaced with a new one. Thus the life-span of the tapping system is clearly increased overall and, most of all, the need for fireproof material is drastically reduced. Furthermore, repair expenses and repair time are considerably lowered in relation to known repair procedures, since only the replacement of the lower end section, easily accessible from the outside, is necessary.

The specialist has various possibilities at his disposal for arranging the lower cylindrical body in such a way as to be replacable in the tapping system but in a sealed manner with regard to the upper end section.

Normally at least the terminal brick is held in a corresponding steel structure at the circumference, as shown in the EP-A 171 658.

In this model the cylindrical body (the disk) is to be attached to the corresponding lower end of the steel structure.

According to a particularly advantageous model, the cylindrical body also has at the outer edge a metal collar that has corresponding stopping means for attachment to the steel structure.

According to one model, said stopping means can consist of outside threads, preferably milled threads pressed from the metal collar, by means of which the cylindrical body is detachably attached to corresponding internal threads in the area of the steel structure.

The cylindrical body is then, for all practical purposes, screwed into the steel structure until the upper surface presses against the lower surface of the upper terminal brick section. It is also possible to attach the cylindrical body using wedges that are driven in from below between the body and the steel structure.

To balance out any existing tolerances, an elastic intermediate layer can be laid on the upper surface of the cylindrical section beforehand, for example a fireproof ceramic fiber mat (that of course also has a passage opening in the middle) and that is then pressed together between the lower and the upper terminal brick section.

If the lower cylindrical section is to be replaced, it is simply screwed off by means of the threads and replaced with a new component.

If the terminal brick section above it shows signs of erosion, it can then be improved by means of a known repair substance, for example, with the new end disk serving as template.

According to an alternative model, at least two radially extending pins, preferably three or more, are attached to the outer edge of the metal collar. In this model the corresponding section of the steel structure then has corresponding take-up slits that have an opening width equal to, or slightly greater than, the diameter of the pins and the cylindrical body is then inserted with its radially extending pins into the take-up slits and attached there. To guarantee sure stopping between the two parts of the terminal brick, the take-up slits are preferably structured in such a way that they extend from the lower surface of the steel structure in a curved path upwards and then pass into a section as horizontal as possible. In this case it is a bayonet-type union.

It is obvious that the take-up slits are open towards the inside, i.e. in the direction of the cylindrical body, since that is the only way the pins could be slid in.

This model is explained in greater detail in the graphically represented example described below.

The metal collar can be shrink-fitted to the ceramic body, but the ceramic cylindrical section can also be glued or laid into the collar, preferably with the help of an appropriate mortar.

According to a model of the invention, the steel collar is drawn around the bottom of the cylindrical body and grips the body at least partially.

In this way it is ensured that the ceramic component cannot fall out downwards.

In this model the lower part of the collar extends over the lower surface of the ceramic body in such a way that a cylindrical cavity is created after closing of the bottom cover plate of the tapping system.

This cavity can be filled in by having, for example, a fireproof ceramic mat, corresponding in its dimensions to the cavity, arranged on the cover plate, which also prevents the granulated material from trickling out (as described above).

The cylindrical body can also be extended downwards on its lower part that is not covered by the metal collar, in such a way that the lower face of the lower terminal brick section is aligned with the lower face of the collar.

The lower and upper terminal brick sections can be made of the same material.

But the particularly erosion endangered lower section is preferably produced from a material that has a greater resistance to erosion than the material of the upper section.

The ceramic material can be made of, for example:

a carbon containing material with $Al_2O_3$ or MgO or $ZrO_2$ with carbon or ceramic bonding the aforementioned material with subsequent pitch impregnation silicium carbide (SiC), ceramically or self-bound or nitride bound.

To further increase the durability, the lower disk can be an isostatically pressed part.

As the disk only represents an infinitely small part in relation to the overall tap, the higher production costs due to better quality are virtually of no consequence. On the contrary, an additional cost advantage also results from the greater service life.

Finally the structure of a terminal brick according to the invention also makes simultaneous inert gas circulation possible.

Corresponding passage canals running essentially radially can thus be arranged in the lower ceramic section, connected with each other outside by a common circular tunnel that has a connection area through which an inert gas line is connected.

In this model a corresponding opening in the steel structure is then provided for the gas supply line and the gas connection is arranged in the cylindrical body in such a way that it lies directly in front of the opening in the steel structure after the lower section is firmly connected to the upper section of the terminal brick, and the gas line can thus be directly connected.

According to an advantageous model of the invention, the gas supply canals do not run exactly radially, but rather between a radial and tangential arrangement in relation to the circumference of the inner surface of the passage opening, through which the flow of the circulating inert gas, argon for example, can be regulated.

This model is further explained using the example below.

The following figures show in

Figure 1A:
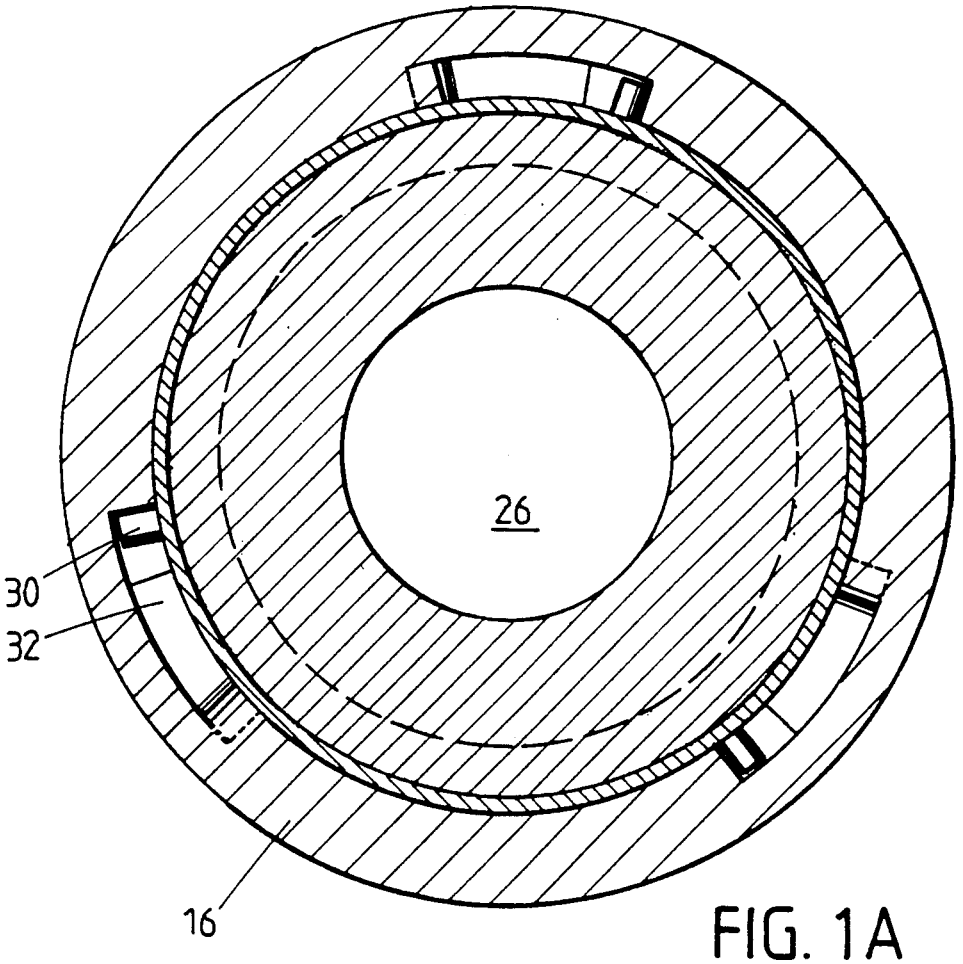

FIG. 1 a vertical section through a terminal brick divided into two parts according to the invention FIG. 1A a view of a horizontal section along Line A—A of FIG. 1.

Figure 2:
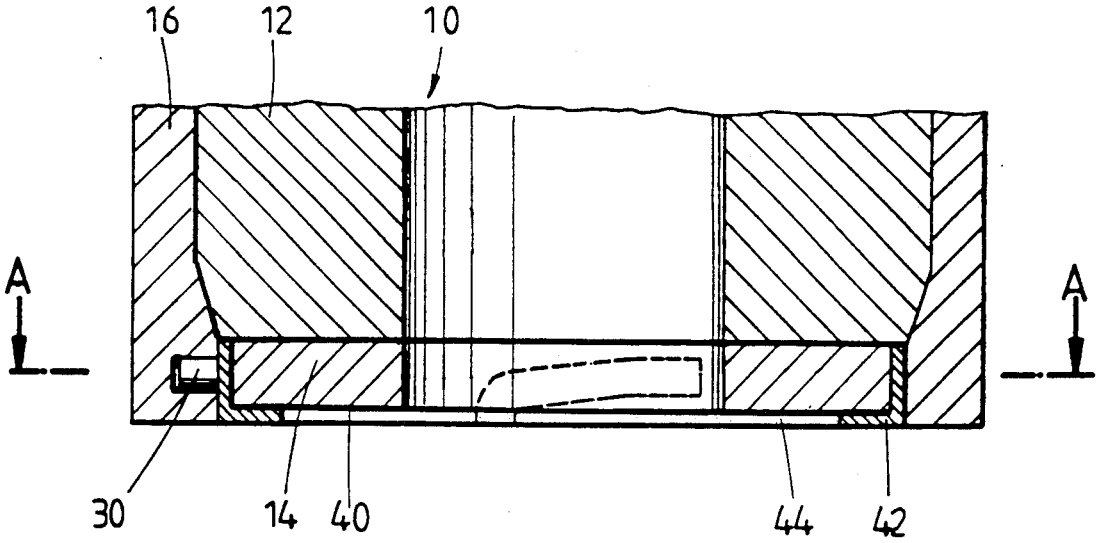
Figure 2A:
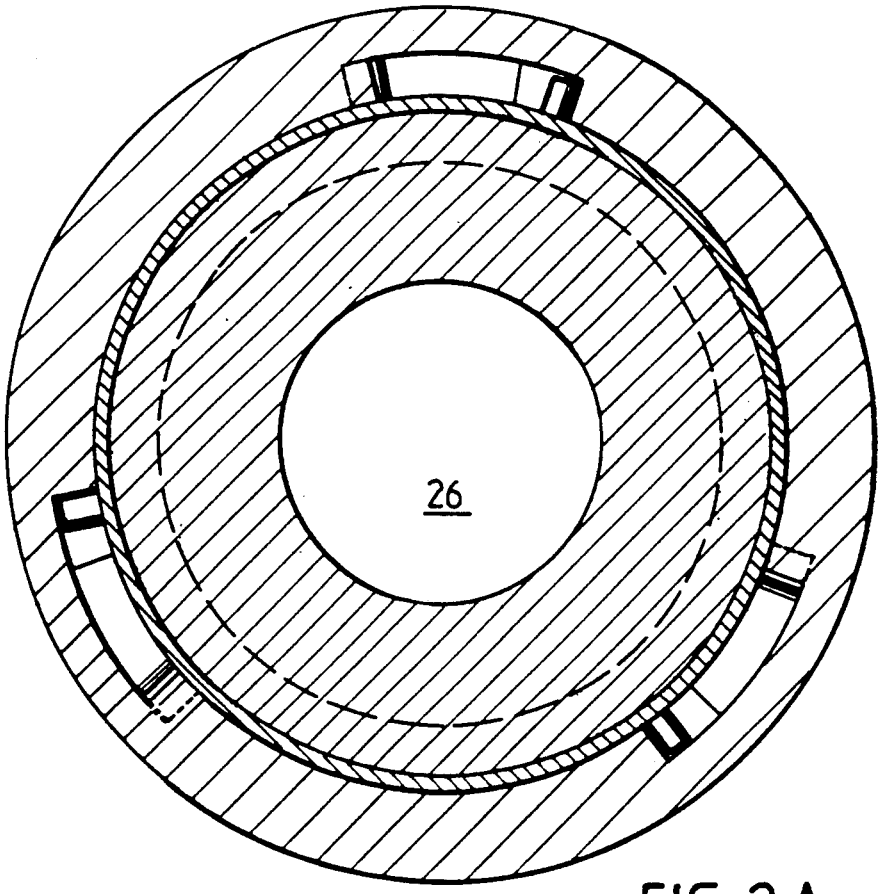
Figure 3:
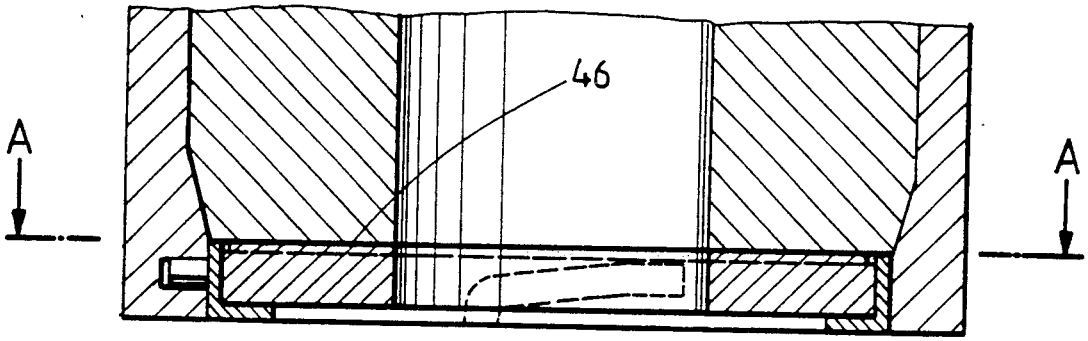

FIG. 2 a corresponding illustration in conformity with FIG. 1 with an alternative model of the lower terminal brick section, FIG. 2A a view of a horizontal section along Line A—A of FIG. 2, FIG. 3 also a corresponding illustration as FIG. 1 with a third model of the lower section of the terminal brick, with a possibility provided for inert gas circulation.

Figure 3A:
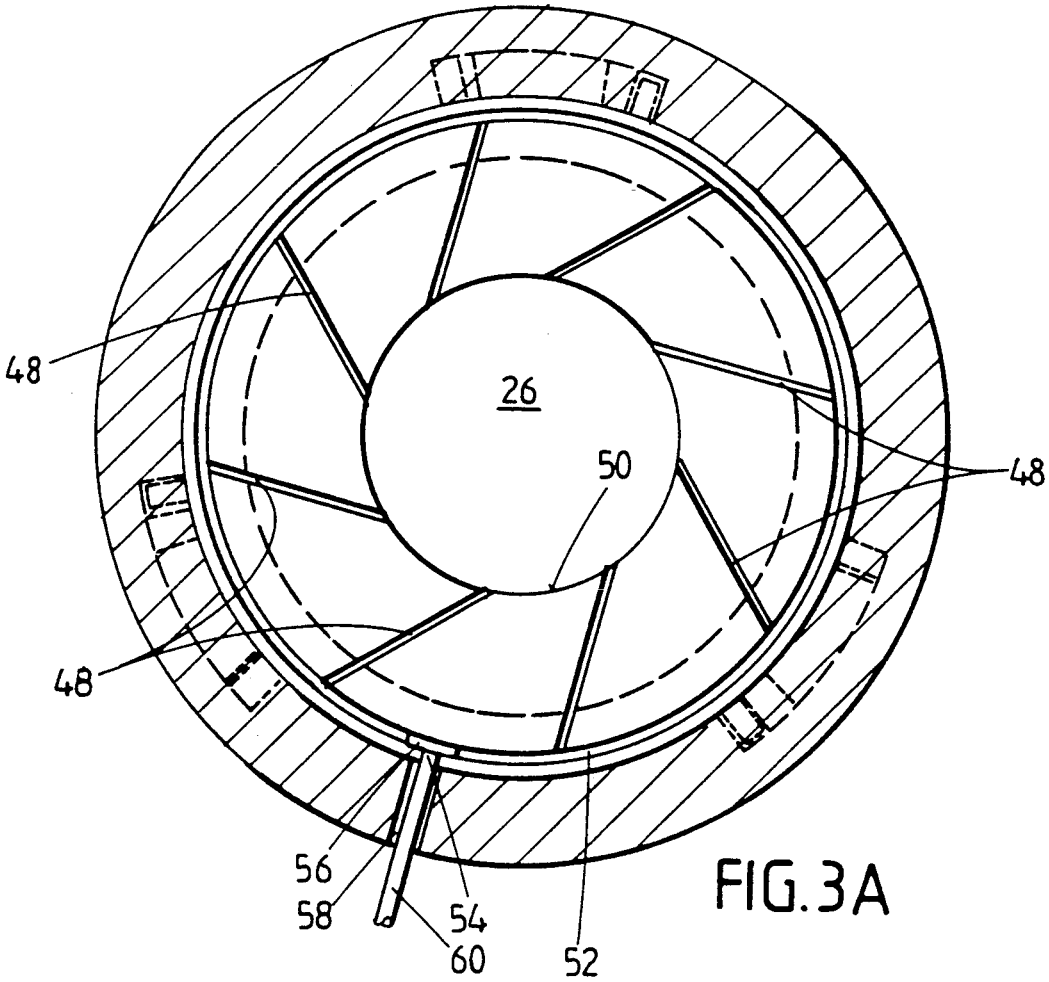

FIG. 3A a view of a horizontal section along line A—A of FIG. 3.

In the figures the same components are represented with the same reference designations.

In the model represented in FIG. 1, the lower section of the terminal brick 10 of a tapping system is represented. The terminal brick 10 consists of an upper section 12 and a lower section 14. The terminal brick 10 is inserted in a steel structure 16.

The upper section 12 of the terminal brick 10 has an essentially cylindrical shape and is formed somewhat conically tapering in its lower part at 18 and lays on a corresponding, diagonally running level 20 of the steel structure 16 at that point. The upper section 12 has a middle cylindrical passage opening 22.

A cylindrical part 24 of the steel structure 16 is connected at the level 20 running diagonally inward. The lower section 14 of the terminal brick 10 is inserted in this cylindrical part 24.

The lower section 14 also has the shape of a cylindrical section with a passage opening 26 corresponding to the passage opening 22 and consists of a fireproof ceramic body **14*a* that is inserted by means of a fireproof mortar in a metal collar 28 that encloses the ceramic body 14*a*** at the outside and the lower side in the edge area.

To form an aligned lower surface, the ceramic body **14*a* is constructed extended downwards (14*b*) in the area not covered by the metal collar 28**.

The metal collar 28 has on the outside three metal pins 30 each arranged at an angle of 120 degrees in relation to the other and welded onto the metal collar 28.

The pins 30 are inserted in corresponding take-up slits 32 that are formed on the inner side in the steel structure 16. As is evident, particularly from the shaded illustration in the upper part of FIG. 1, the take-up slits 32 first run from the lower surface 34 axially upwards (36*a*), then pass into a bent section 36*b* and finally end in an end section 36*c* arranged parallel to the lower surface 34.

In the assembly of the lower section 14, it is thus guided with the pins 30 along the take-up slits in a turning motion onto the upper section 12 until the pins 30 hit against the rear face of the take-up slits 32. Assembly can be carried out using a tool, and corresponding anchoring holes can be provided in the lower surface of the metal collar.

Dimensions of the lower section 14, the pins 30 or the take-up slits 32 are selected in such a way that the lower section 14 lays against the upper section 12 of the terminal brick 10 directly and sealingly at the instant when the pins 30 push against the rear end of the take-up slits 32 or are positioned just in front of them.

To be able to balance out certain tolerances related to production techniques, a thin elastic intermediate layer can be arranged between the lower section 14 and the upper section 12, for example a fireproof ceramic non-woven fabric.

If an erosion of the fireproof material has occurred at the lower edge of the section 14 at 38 in the course of various charges, it is no longer necessary, as it is in the current state of the art, to replace the entire terminal brick or the entire tapping system, rather the lower section 14 can now be screwed in direction inverse to the assembly from the outside and replaced with a new section 14 without problems.

The tapping system is then immediately available again for further castings.

The model example according to FIG. 2 corresponds to that of FIG. 1 with one exception. The difference is that the lower section 14 is formed as disk of constant height in such a way that a cylindrical cavity 44 is formed between the lower surface 40 of the cylindrical body 14 and the lower surface 42 of the metal collar 28.

To prevent granulated material consisting of, for example, olivine from running out after being filled, as described in the beginning, into the passage openings 22, 26, in this model an elastic fireproof fiber mat is preferably placed on the (not shown) lower metal cover of the tapping system, corresponding in its dimensions to the cavity 44 and filling the latter as long as the metal cover is in the closed position.

Finally, the model according to FIG. 3 corresponds to that of FIG. 2 with a further exception. In this case, several canals 48 extend from the upper surface 46 of the cylindrical section 14 into the fireproof material and these canals have an alignment that is between a radial and a tangential position in relation to the inner side 50 of the passage opening 26, as can easily be seen on the lower part of FIG. 3.

The canals 48 open out at their inner end into the passage opening 26 and at their outer end into a circular canal 52 at the outer side, which has a connection piece 56 at 54 which extends through the metal collar 28 and is located at a position that lies directly opposite a radial opening 58 in the steel structure 16 after the lower section 14 has been firmly fixed against the upper section 12 of the terminal brick 10, in such a way that a gas supply line 60 can be led through the opening 58 at this position and attached to the connecting pieces 56. In later operation, i.e. at the instant when the metal smelt flows out, an inert gas such as argon is circulated in through the gas supply line 60, to then be fed through the circular canal 52 and the canals 48 into the passage opening 26 for the purpose of avoiding increased oxidation of the metal smelt.

Naturally the arrangement of the canals 48 can also be done differently and an additional circular canal for feeding the inert gas in can also be provided in the area of the passage opening 26.

We claim:

1. Fireproof ceramic terminal brick apparatus for a tapping system in a metallurgical apparatus, comprising a metal shell, an upper section housed within the metal shell, a replaceable lower section formed as a cylindrical body, and connecting-disconnecting means for releasably holding the lower section inside the metal shell against the upper section so that when the fireproof ceramic terminal brick apparatus is in use the lower section is pressed firmly against the upper section to seal the upper section and the lower section together, and for releasing the lower section from contact with the upper section when desired so that when the lower section is damaged and needs to be replaced the lower section may be released from contact with the upper section for easy replacement of the lower section.

2. The terminal brick of claim 1, wherein the lower section is disc-shaped and has a lower height than the upper section.

3. The terminal brick of claim 1, wherein the lower section has a metal collar formed around the outside thereof.

4. The terminal brick of claim 3, wherein the metal collar is drawn around the lower section at least partially on the bottom of the lower section.

5. The terminal brick of claim 4, wherein the lower section includes a lower area not covered by the metal collar that extends downwardly and forms a common lower surface with the bottom of the corresponding edge section of the metal collar.

6. The terminal brick of claim 3, the metal collar being shrink fitted to the lower section.

7. The terminal brick of claim 3, wherein the connecting-disconnecting means includes outside milled threads pressed out of the metal collar and corresponding inside threads in the area of a steel structure surrounding the entire terminal brick by means of which the lower section may be detachably fastened to the entire terminal brick.

8. The terminal brick of claim 3, wherein the connecting-disconnecting means includes at least two radially extending pins attached to the outer edge of the metal collar for detachably connecting the lower section in corresponding take-up slits formed in a steel structure surrounding the entire terminal brick.

9. The terminal brick of claim 1, wherein the lower section comprises a material that has a greater resistance to erosion than the material of the upper section of the terminal brick.

10. The terminal brick of claim 9, wherein the lower section comprises a carbon-containing ceramic material with the base of $Al_2O_3$ or MgO or $ZrO_2$ with carbon or ceramic bonding or silicon carbide, ceramically or self-bound nitride bound ceramic material.

11. The terminal brick of claim 9, wherein the lower section is an isostatically pressed part.

12. The terminal brick of claim 1, wherein the lower section has one or more canals that are connected together, with at least one canal opening into the passage opening of the lower section and at least one canal being opened to the outer edge of the lower section for connection to a gas supply line.

13. The terminal brick of claim 12, wherein the canals run in the area of the upper surface of the lower section.

14. The terminal brick of claim 12, wherein the canals have an alignment that is between a radial and a tangential arrangement in relation to the inner surface of the passage opening.

15. The terminal brick of claim 10, wherein the lower section is an isostatically pressed part.

16. The terminal brick of claim 13, wherein the canals have an alignment that is between a radial and a tangential arrangement in relation to the inner surface of the passage opening.

17. Fireproof ceramic terminal brick apparatus for a tapping system in a metallurgical apparatus, comprising a metal shell, an upper section housed within the metal shell, a replaceable lower section formed as a cylindrical body, connecting-disconnecting means on the lower section for releasably holding the lower section inside the metal shell against the upper section so that when the fireproof ceramic terminal brick apparatus is in use the lower section is pressed firmly against the upper section to seal the upper section and the lower section together, and for releasing the lower section from contact with the upper section when desired so that when the lower section is damaged and needs to be replaced the lower section may be released from contact with the upper section for easy replacement of the lower section, the lower section being disc-shaped and having a lower height than the upper section, the lower section having a metal collar formed around the outside thereof, the metal collar being drawn around the lower section at least partially on the bottom of the lower section, the lower section including a lower area not covered by the metal collar that extends downwardly and forms a common lower surface with the bottom of the corresponding edge section of the metal collar, the metal collar being shrink fitted to the lower section, the connecting-disconnecting means including outside milled threads pressed out of the metal collar and corresponding inside threads in the area of a steel structure surrounding the entire terminal brick by means of which the lower section may be attachably fastened to the entire terminal brick, the lower section comprising a material that has greater resistance to erosion than the material of the upper section of the terminal brick, the lower section comprising a carbon-containing ceramic material with the base of $Al_2O_3$ or MgO or $ZrO_2$ with carbon or ceramic bonding or silicium carbide, ceramically or self-bound nitride bound ceramic material, the lower section being an isostatically pressed part, the lower section having one or more canals that are connected together, with at least one canal opening into the passage opening of the lower section and at least one canal being opened to the outer edge of the lower section for connection to a gas supply line, the canals running in the area of the upper surface of the lower section, and the canals having an alignment that is between a radial and a tangential arrangement in relation to the inner surface of the passage opening.

* * * * *